US011136676B2

(12) United States Patent
Unal et al.

(10) Patent No.: US 11,136,676 B2
(45) Date of Patent: Oct. 5, 2021

(54) METHODS OF PREPARING 7XXX ALUMINUM ALLOYS FOR ADHESIVE BONDING, AND PRODUCTS RELATING TO THE SAME

(71) Applicant: ARCONIC INC., Pittsburgh, PA (US)

(72) Inventors: Ali Unal, Export, PA (US); June M. Epp, Pittsburgh, PA (US); James M. Marinelli, Murrysville, PA (US); Marissa Menanno, Latrobe, PA (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 17 days.

(21) Appl. No.: 16/508,161

(22) Filed: Jul. 10, 2019

(65) Prior Publication Data

US 2019/0330750 A1 Oct. 31, 2019

Related U.S. Application Data

(63) Continuation of application No. PCT/US2017/068949, filed on Dec. 29, 2017.

(60) Provisional application No. 62/447,720, filed on Jan. 18, 2017.

(51) Int. Cl.

| | |
|---|---|
| ***C23G 1/22*** | (2006.01) |
| ***B08B 3/08*** | (2006.01) |
| ***C22C 21/10*** | (2006.01) |
| *B24C 1/06* | (2006.01) |

(52) U.S. Cl.

CPC ..... *C23G 1/22* (2013.01); *B08B 3/08* (2013.01); *C22C 21/10* (2013.01); *B24C 1/06* (2013.01)

(58) Field of Classification Search

None

See application file for complete search history.

(56) References Cited

U.S. PATENT DOCUMENTS

| | | | |
|---|---|---|---|
| 2,353,786 | A | 7/1944 | Ross |
| 2,762,694 | A | 9/1956 | Newman |
| 4,097,270 | A | 6/1978 | Rao et al. |
| 4,149,912 | A | 4/1979 | Craighead et al. |
| 5,190,596 | A | 3/1993 | Timsit |
| 5,277,788 | A | 1/1994 | Nitowski et al. |

(Continued)

FOREIGN PATENT DOCUMENTS

| | | |
|---|---|---|
| JP | 2008-291336 | 12/2008 |
| JP | 2009-167464 | 7/2009 |
| WO | WO 02/031073 | 4/2002 |

OTHER PUBLICATIONS

Hughes, Anthony E., et al., "High strength Al-alloys: microstructure, corrosion and principles of protection", pp. 223-262, Recent Trends in Processing and Degradation of Aluminium Alloys, Prof. Zaki Ahmad (Ed.) (2011).

(Continued)

*Primary Examiner* — Eric W Golightly

(74) *Attorney, Agent, or Firm* — Greenberg Traurig, LLP

(57) ABSTRACT

Methods of preparing 7xxx aluminum alloy products for adhesive bonding are disclosed. Generally, the methods include chemical and/or mechanically preparing a 7xxx aluminum alloy product to reduce the amount of magnesium oxides while maintaining any copper-containing intermetallic particles located proximal the surface of the 7xxx aluminum alloy product. After preparation, a functionalized layer may be produced thereon for adhesive bonding.

20 Claims, 13 Drawing Sheets

(56) References Cited

U.S. PATENT DOCUMENTS

| | | | | |
|---|---|---|---|---|
| 6,117,794 | A | 9/2000 | Dormer et al. | |
| 6,167,609 | B1 | 1/2001 | Marinelli et al. | |
| 6,485,541 | B1 | 11/2002 | Hryn et al. | |
| 7,267,158 | B2 | 9/2007 | Kolek et al. | |
| 8,414,711 | B2 | 4/2013 | Uchida et al. | |
| 8,540,826 | B2 | 9/2013 | Ray et al. | |
| 2006/0032757 | A1 | 2/2006 | Brevnov et al. | |
| 2006/0127684 | A1* | 6/2006 | Naritomi | C23F 1/36 428/457 |
| 2010/0243108 | A1 | 9/2010 | Karabin et al. | |
| 2011/0315658 | A1 | 12/2011 | Shibata et al. | |
| 2015/0075756 | A1 | 3/2015 | Garosshen | |

OTHER PUBLICATIONS

International Search Report and Written Opinion, dated Apr. 19, 2018, from corresponding International Patent App. No. PCT/US2017/068949.

ASTM Designation F2792-12a, "Standard Terminology for Additive Manufacturing Technologies," ASTM International, Conshohocken, PA, US, 2014.

Das, S. K., et al., "Reduction of oxidative melt loss of aluminum and its alloys, final report", DE-FC36-00ID13898, Argonne National Laboratory, Argonne, IL, et al., Feb. 2006.

Kaufherr, N. et al., "Chemical cleaning of aluminum alloy surfaces for use as vacuum materials in synchrotron light sources", 36$^{th}$ Annual Symposium of the American Vacuum Society, Oct. 23-27, 1989.

Kim, K. H., "Formation of endogenous MgO and $MgAl_2O_4$ particles and their possibility of acting as substrate for heterogeneous nucleation of aluminum grains", *Surface and Interface Analysis,* 47:429-438, Jan. 2015.

Wefers, K. "Properties and characterization of surface oxides on aluminum alloys", May 20, 1981.

Tian, W., et al., "Intergranular corrosion of spark plasma sintering assembled bimodal grain sized AA7075 aluminum alloys", Corrosion Science 107:211-224 (2016).

* cited by examiner

METHODS OF PREPARING 7XXX ALUMINUM ALLOYS FOR ADHESIVE BONDING, AND PRODUCTS RELATING TO THE SAME

CROSS-REFERENCE TO RELATED APPLICATIONS

This application is a continuation of International Patent App. No. PCT/US2017/068949, filed Dec. 29, 2017, which claims the benefit of priority of U.S. Provisional Patent Application No. 62/447,720, filed Jan. 18, 2017, each of which is incorporated herein by reference in its entirety.

BACKGROUND

7xxx aluminum alloys are aluminum alloys having zinc and magnesium as their primary alloying ingredients, besides aluminum. It would be useful to facilitate adhesive bonding of 7xxx aluminum alloys to itself and other materials (e.g., for automotive applications).

SUMMARY OF THE INVENTION

Broadly, the present disclosure relates to methods of preparing 7xxx aluminum alloys for production of a functionalized layer thereon (e.g., for adhesive bonding). In particular, and referring now to FIGS. 1-3, a method may comprise receiving (100) a 7xxx aluminum alloy product (1) having a 7xxx aluminum alloy base (10) with a surface oxide layer (5) thereon. The surface oxide layer (5) may include a first portion/layer (20) generally comprising magnesium oxides ("the magnesium oxide layer(s)"), a second portion/layer (30) generally comprising aluminum oxides ("the aluminum oxide layer(s)"), and a third/portion layer (40) generally comprising a mixture of magnesium oxides and aluminum oxides ("the mixed magnesium oxide-aluminum oxide layer(s)"). These portions/layers (20, 30, 40) may be formed, for instance, due to normal processing (mechanical and/or thermal processing) encountered by the 7xxx aluminum alloy product. Although the various portions/layers (20, 30, 40) are being shown as uniform, this is for illustrative purposes only as the portions/layers are generally non-uniform/have an irregular topography.

As illustrated in FIG. 1, the magnesium oxide layer (20) (e.g., comprising MgO) generally overlays the aluminum oxide layer (30) (e.g., comprising $Al_2O_3$), which is disposed on the surface of the 7xxx aluminum alloy base (10). The as-received surface oxide layer (5) generally has an as-received thickness (shown via arrow), which is at least partially defined by these magnesium oxide and aluminum surface layers (20, 30). The as-received thickness of the surface oxide layer (5) is generally 20-60 nm thick. Oxides that may be included in these layers include MgO, $MgAl_2O_4$, $Al_2O_3$, AlOOH, and $Al(OH)_3$, for instance. As shown below, reducing the volume fraction of the magnesium oxide layer (20), while maintaining or increasing the volume fraction of the aluminum oxide layer (30) may facilitate production of 7xxx aluminum alloy products having functional layers properly bonded thereto.

The 7xxx aluminum alloy base (10) may include various precipitates and intermetallic particles. Among these may be copper-bearing intermetallic particles (e.g., dominant copper-bearing intermetallic particles, such as $Al_7Cu_2Fe$ particles). In the illustrated embodiment of FIG. 1, a copper-bearing intermetallic particle (50) is included in the 7xxx aluminum alloy base (10) and is located proximal the surface oxide layer (5). These surface or near-surface copper-bearing intermetallic particles (50) may interrupt the aluminum oxide (30) and magnesium oxide (20) layers, causing formation of the thin, mixed magnesium oxide-aluminum oxide layer (40) (e.g., a mixed MgO—$Al_2O_3$ layer). As shown below, de-alloying of these copper-bearing intermetallic particles (50) may cause corrosion issues and/or adhesive bonding issues.

In one approach, a method comprises reducing (200) the as-received thickness of the surface oxide layer (5) of the 7xxx aluminum alloy product (1) to a preparation thickness, where the reducing step (200) comprises at least one of (i) reducing a volume fraction of the magnesium oxides of the surface oxide layer, (ii) increasing a volume fraction of the aluminum oxides of the surface oxide layer, and (iii) maintaining a volume fraction of the copper-bearing intermetallic particles proximal the surface oxide layer, thereby producing a prepared 7xxx aluminum alloy product. As described in further detail below, this reducing step (200) may comprise a chemical preparation and/or a mechanical preparation.

While the word 'layer' is used herein for illustrative purposes, it is to be understood that no specific topography is to be imparted into the meaning of the word layer; the topography of the oxide may be any normal oxide topography, whether as-received or as-prepared. Further, it is to be understood that the word "layer" does not require any specific layer structure to be present in the oxide; the chemical constituents making up the magnesium oxide layer (20) versus the aluminum layer (30) may vary, where some aluminum oxides are included in the magnesium layer (20), and vice-versa for the aluminum oxide layer (30).

After the reducing step (200) and any appropriate intervening steps (e.g., rinsing), a method may include contacting (300) the prepared 7xxx aluminum alloy product with an appropriate chemical (e.g., a phosphorus-containing organic acid) to form a functionalized layer. In one embodiment, the contacting step (300) may include contacting the prepared 7xxx aluminum alloy product with any of the phosphorus-containing organic acids disclosed in U.S. Pat. No. 6,167,609 to Marinelli et al., which is incorporated herein by reference. A layer of polymeric adhesive may then be applied to the functionalized layer (e.g., for joining to a metal support structure to form a vehicle assembly). The contacting step (300) may include other chemical methods, such as those using titanium, or titanium with zirconium, to facilitate production of the functionalized layer.

I. Reducing the Surface Oxide Thickness

As noted above, the method generally includes reducing (200) the as-received thickness of the surface oxide layer, and this method generally includes at least one of (i) reducing a volume fraction of the magnesium oxides of the surface oxide layer, (ii) increasing a volume fraction of the aluminum oxides of the surface oxide layer, and (iii) maintaining a volume fraction of the copper-bearing intermetallic particles proximal the surface oxide layer (e.g., by restricting or avoiding de-alloying of copper-bearing intermetallic particles), thereby producing a prepared 7xxx aluminum alloy product. Reducing the magnesium oxide and/or increasing the aluminum oxide content may facilitate bonding of the functionalized layer during contacting step (300). Further, maintaining a volume fraction of the copper-bearing intermetallic particles proximal the surface oxide layer may restrict production of element copper (e.g., from the copper-bearing intermetallic particles), which elemental copper may interfere with proper bonding of the functionalized layer and/or the polymeric layer applied thereto. In one embodiment, a method includes both (i) reducing a volume fraction of the magnesium oxides of the surface oxide layer and (ii) increasing a volume fraction of the aluminum oxides of the surface oxide layer. In one embodiment, a method includes both (i) reducing a volume fraction of the magnesium oxides of the surface oxide layer and (iii) maintaining a volume fraction of the copper-bearing intermetallic particles proximal the surface oxide layer. In one embodiment, a method includes both (ii) increasing a volume fraction of the aluminum oxides of the surface oxide layer, and (iii) maintaining a volume fraction of the copper-bearing intermetallic particles proximal the surface oxide layer. In one embodiment, a method includes all of (i) reducing a volume fraction of the magnesium oxides of the surface oxide layer, (ii) increasing a volume fraction of the aluminum oxides of the surface oxide layer, and (iii) maintaining a volume fraction of the copper-bearing intermetallic particles proximal the surface oxide layer.

After the reducing step (200), the surface oxide layer of the prepared 7xxx aluminum alloy product has a prepared thickness. This prepared thickness may be any suitable thickness that facilitates later successful production of the functionalized layer. In one embodiment, the prepared thickness of the surface oxide layer is no greater than 20 nm. In another embodiment, the prepared thickness is no greater than 17.5 nm. In yet another embodiment, the prepared thickness is no greater than 15 nm. In another embodiment, the prepared thickness is no greater than 12.5 nm. In yet another embodiment, the prepared thickness is no greater than 10 nm. In another embodiment, the prepared thickness is no greater than 7.5 nm.

A. Chemical Preparation

As disclosed above, the reducing step (200) may comprise reducing the as-received surface oxide thickness via a chemical preparation. In this regard, the reducing step (200) may include contacting the as-received surface oxide with a preparation solution for a time sufficient to reduce the as-received thickness of the surface oxide to a preparation thickness while maintaining the volume fraction of the copper-bearing intermetallic particles proximal the surface oxide. In this context, "maintaining the volume fraction of the copper-bearing intermetallic particles proximal the surface oxide layer" and the like refers to a chemical preparation that restricts (e.g. avoids, prevents) substantial de-alloying of the copper-bearing intermetallic particles proximal the surface oxide layer such that suitable corrosion resistance and adhesive bonding is realized by the 7xxx aluminum alloy product having a functionalized layer thereon. De-alloying of copper-bearing intermetallic particles may result in degraded corrosion resistance and/or degraded adhesive bonding relative to the later applied functional layer. In one embodiment, the reducing step comprises contacting the as-received surface oxide layer with the preparation solution for a time sufficient to reduce the as-received thickness to the preparation thickness and in the absence of substantial de-alloying of the copper-bearing intermetallic particles proximal the surface oxide layer. In one embodiment, the volume fraction of magnesium oxides is reduced and the volume fraction of aluminum oxides is increased while the volume fraction of the copper-bearing intermetallic particles proximal the surface oxide layer is maintained.

In one embodiment, due to the chemical preparation, the surface oxide layer comprises no greater than 10 at. % of magnesium oxides. In one embodiment, due to the chemical preparation, the surface oxide layer comprises no greater than 8 at. % of magnesium oxides. In one embodiment, due to the chemical preparation, the surface oxide layer comprises no greater than 6 at. % of magnesium oxides. In one embodiment, due to the chemical preparation, the surface oxide layer comprises no greater than 4 at. % of magnesium oxides. In one embodiment, due to the chemical preparation, the surface oxide layer comprises no greater than 2 at. % of magnesium oxides. In one embodiment, due to the chemical preparation, the surface oxide layer comprises no greater than 1 at. % of magnesium oxides. In one embodiment, due to the chemical preparation, the surface oxide layer is essentially free of magnesium oxides. In one embodiment, due to the chemical preparation, the surface oxide layer consists essentially of aluminum oxides.

The preparation solution may be any suitable solution that realizes reduction of the as-received surface oxide layer while maintaining a volume fraction of the copper-bearing intermetallic particles. Suitable alkaline and acidic solutions are described below. The chemical preparation may include spraying, immersion, roll coating or any combination of these chemical contacting methods. After the chemical preparation, the 7xxx aluminum alloy product may be rinsed (e.g., via city water or deionized water), after which the functional layer may be created thereon.

i. Alkaline Preparation Solutions

In one approach, the preparation solution is alkaline. In one embodiment, the alkaline solution is a mild alkaline solution comprising a pH of no greater than 10 (e.g., having a pH of from 7.1 to 10). In one embodiment, the alkaline solution is BONDERITE 4215 NC, produced by HENKEL Corp., 1 Henkel Way, Rocky Hill, Conn., 06067 United States, or an equivalent thereof.

An alkaline preparation solution may be used at elevated temperatures (e.g., from 100-150° F.). Depending on temperature, the alkaline preparation solution may contact/be applied to the as-received 7xxx aluminum alloy product for at least 20 seconds. In one embodiment, the preparation solution contacts the as-received 7xxx aluminum alloy product for at least 60 seconds. In one embodiment, the preparation solution contacts the as-received 7xxx aluminum alloy product for at least 90 seconds. Any suitable alkaline preparation times and temperatures may be used to reduce the as-received thickness of the surface oxide layer, provided the volume fraction of copper-bearing intermetallic particles proximal the surface oxide is maintained.

ii. Acidic Preparation Solutions

In another approach, the preparation solution is acidic. In one embodiment, the acidic solution comprises a pH of no greater than 3 (e.g., having a pH of from 1 to 3). In one embodiment, the alkaline solution comprises nitric acid (e.g., an 8 wt. % nitric acid solution) or an equivalent thereof.

An acidic preparation solution may be used at about ambient temperature (e.g., from 70-90° F.). Depending on temperature, the acidic preparation solution may contact/be applied to the as-received 7xxx aluminum alloy product for at least 8 seconds. In one embodiment, the preparation solution contacts the as-received 7xxx aluminum alloy product for at least 15 seconds. In one embodiment, the preparation solution contacts the as-received 7xxx aluminum alloy product for at least 20 seconds. In another embodiment, the preparation solution contacts the as-received 7xxx aluminum alloy product for at least 25 seconds. In yet another embodiment, the preparation solution contacts the as-received 7xxx aluminum alloy product for at least 30 seconds. In another, the preparation solution contacts the as-received 7xxx aluminum alloy product for at least 40 seconds. In yet another, the preparation solution contacts the as-received 7xxx aluminum alloy product for at least 50 seconds. In another, the preparation solution contacts the as-received 7xxx aluminum alloy product for at least 60 seconds. Any suitable acidic preparation times and temperature may be used to reduce the as-received thickness of the surface oxide layer provided the volume fraction of copper-bearing intermetallic particles proximal the surface oxide is maintained.

B. Mechanical Preparation

As disclosed above, the reducing step (200) may comprise reducing the as-received surface oxide thickness via a mechanical preparation. This mechanical preparation may be used in addition to or in lieu of the chemical preparation. In one embodiment, the mechanical preparation is mechanical impingement, which removes at least a portion of the surface oxide layer (5). The mechanical impingement may also remove a portion of the 7xxx aluminum alloy base. Since no chemicals are specifically used to prepare the surface oxide, mechanical preparation generally avoids de-alloying of copper-bearing intermetallic particles. In one embodiment, the mechanical preparation comprises media blasting, such as grit blasting. Machining, sanding, and the like may also/alternatively be used.

In one embodiment, due to the mechanical preparation, the surface oxide layer comprises no greater than 10 at. % of magnesium oxides. In one embodiment, due to the mechanical preparation, the surface oxide layer comprises no greater than 8 at. % of magnesium oxides. In one embodiment, due to the mechanical preparation, the surface oxide layer comprises no greater than 6 at. % of magnesium oxides. In one embodiment, due to the mechanical preparation, the surface oxide layer comprises no greater than 4 at. % of magnesium oxides. In one embodiment, due to the mechanical preparation, the surface oxide layer comprises no greater than 2 at. % of magnesium oxides. In one embodiment, due to the mechanical preparation, the surface oxide layer comprises no greater than 1 at. % of magnesium oxides. In one embodiment, due to the mechanical preparation, the surface oxide layer is essentially free of magnesium oxides. In one embodiment, due to the mechanical preparation, the surface oxide layer consists essentially of aluminum oxides.

II. 7xxx Aluminum Alloys

The methods disclosed herein are generally applicable to 7xxx aluminum alloy products, such as those including copper resulting in the formation of copper-bearing intermetallic particles. In one approach, the 7xxx aluminum alloy product comprises 2-12 wt. % Zn, 1-3 wt. % Mg, and 1-3 wt. % Cu. In one embodiment, the 7xxx aluminum alloy product is one of a 7009, 7010, 7012, 7014, 7016, 7116, 7032, 7033, 7034, 7036, 7136, 7037, 7040, 7140, 7042, 7049, 7149, 7249, 7349, 7449, 7050, 7150, 7055, 7155, 7255, 7056, 7060, 7064, 7065, 7068, 7168, 7075, 7175, 7475, 7178, 7278, 7081, 7181, 7085, 7185, 7090, 7093, 7095, 7099, or 7199 aluminum alloy, as defined by the Aluminum Association Teal Sheets (2015). In one embodiment, the 7xxx aluminum alloy is 7075, 7175, or 7475. In one embodiment, the 7xxx aluminum alloy is 7055, 7155, or 7225. In one embodiment, the 7xxx aluminum alloy is 7065. In one embodiment, the 7xxx aluminum alloy is 7085 or 7185. In one embodiment, the 7xxx aluminum alloy is 7050 or 7150. In one embodiment, the 7xxx aluminum alloy is 7040 or 7140. In one embodiment, the 7xxx aluminum alloy is 7081 or 7181. In one embodiment, the 7xxx aluminum alloy is 7178.

The 7xxx aluminum alloy may be in any form, such as in the form of a wrought product (e.g., a rolled sheet or plate product, an extrusion, a forging). The 7xxx aluminum alloy product may alternatively be in the form of a shape-cast product (e.g., a die casting). The 7xxx aluminum alloy product may alternatively be an additively manufactured product. As used herein, "additive manufacturing" means "a process of joining materials to make objects from 3D model data, usually layer upon layer, as opposed to subtractive manufacturing methodologies", as defined in ASTM F2792-12a entitled "Standard Terminology for Additively Manufacturing Technologies".

III. Creating the Functional Layer

A functional layer may be created on the prepared 7xxx aluminum alloy product after the reducing step (200). Prior to creating the functional layer, the prepared 7xxx aluminum alloy product may be further prepared, such as by rinsing the prepared 7xxx aluminum alloy product. This rinse may include rinsing with water (e.g., deionized water) so as to remove debris and/or residual chemical. In one embodiment, a rinsing step results in growth of additional aluminum oxides on the surface of 7xxx aluminum alloy product, which may nominally increase the thickness of the prepared surface oxide layer.

To create the functional layer, the prepared 7xxx aluminum alloy product is generally exposed to an appropriate chemical, such as an acid or base. In one embodiment, the chemical is a phosphorous-containing organic acid. The organic acid generally interacts with aluminum oxide in the prepared oxide layer to form a functionalized layer. The organic acid is dissolved in water, methanol, or other suitable organic solvent, to form a solution that is applied to the 7xxx aluminum alloy product by spraying, immersion, roll coating, or any combination thereof. The phosphorus-containing organic acid may be an organophosphonic acid or an organophosphinic acid. The pretreated body is then rinsed with water after the acid application step.

The term "organophosphonic acid" includes acids having the formula $R_m[PO(OH)_2]_n$ wherein R is an organic group containing 1-30 carbon atoms, m is the number of organic groups and is about 1-10, and n is the number of phosphonic acid groups and is about 1-10. Some suitable organophosphonic acids include vinyl phosphonic acid, methylphosphonic acid, ethylphosphonic acid, octylphosphonic acid and styrenephosphonic acid The term "organophosphinic acid" includes acids having the formula $R_mR'_o[PO(OH)]_n$ wherein R is an organic group containing 1-30 carbon atoms, R' is hydrogen or an organic group containing 1-30 carbon atoms, m is the number of R groups and is about 1-10, n is the number of phosphinic acid groups and is about 1-10, and o is the number of R' groups and is about 1-10. Some suitable organophosphinic acids include phenylphosphinic acid and bis-(perfluoroheptyl) phosphinic acid.

In one embodiment, a vinyl phosphonic acid surface treatment is used that forms essentially a monolayer with aluminum oxide in the surface layer. The coating areal weight may be less than about 15 $mg/m^2$. In one embodiment, the coating areal weight is only about 3 $mg/m^2$.

An advantage of these phosphorus-containing organic acids is that the pretreatment solution contains less than about 1 wt. % chromium and preferably essentially no chromium. Accordingly, environmental concerns associated with chromate conversion coatings are eliminated.

The functionalized 7xxx aluminum alloy product may then be cut in desired sizes and shapes and/or worked into a predetermined configuration. Castings, extrusions and plate may also require sizing, for example by machining, grinding or other milling process. Shaped assemblies made in accordance with the invention are suitable for many components of vehicles, including automotive bodies, body-in-white components, doors, trunk decks and hood lids. The functionalized 7xxx aluminum alloy products may be bonded to a metal support structure using a polymeric adhesive.

In manufacturing automotive components, it is often necessary to join the functionalized 7xxx aluminum alloy material to an adjacent structural member. Joining functionalized 7xxx aluminum alloy materials may be accomplished in two steps. First, a polymeric adhesive layer may be applied to the functionalized 7xxx aluminum alloy product, after which it is pressed against or into another component (e.g., another functionalized 7xxx aluminum alloy product; a steel product; a 6xxx aluminum alloy product; a 5xxx aluminum alloy product; a carbon reinforced composite). The polymeric adhesive may be an epoxy, a polyurethane or an acrylic.

After the adhesive is applied, the components may be spot welded together, e.g., in a joint area of applied adhesive. Spot welding may increase peel strength of the assembly and may facilitate handling during the time interval before the adhesive is completely cured. If desired, curing of the adhesive may be accelerated by heating the assembly to an elevated temperature. The assembly may then be passed through a zinc phosphate bath, dried, electrocoated, and subsequently painted with an appropriate finish.

DETAILED DESCRIPTION

Example 1—Preparation with Alkaline Solution

Figure 1:
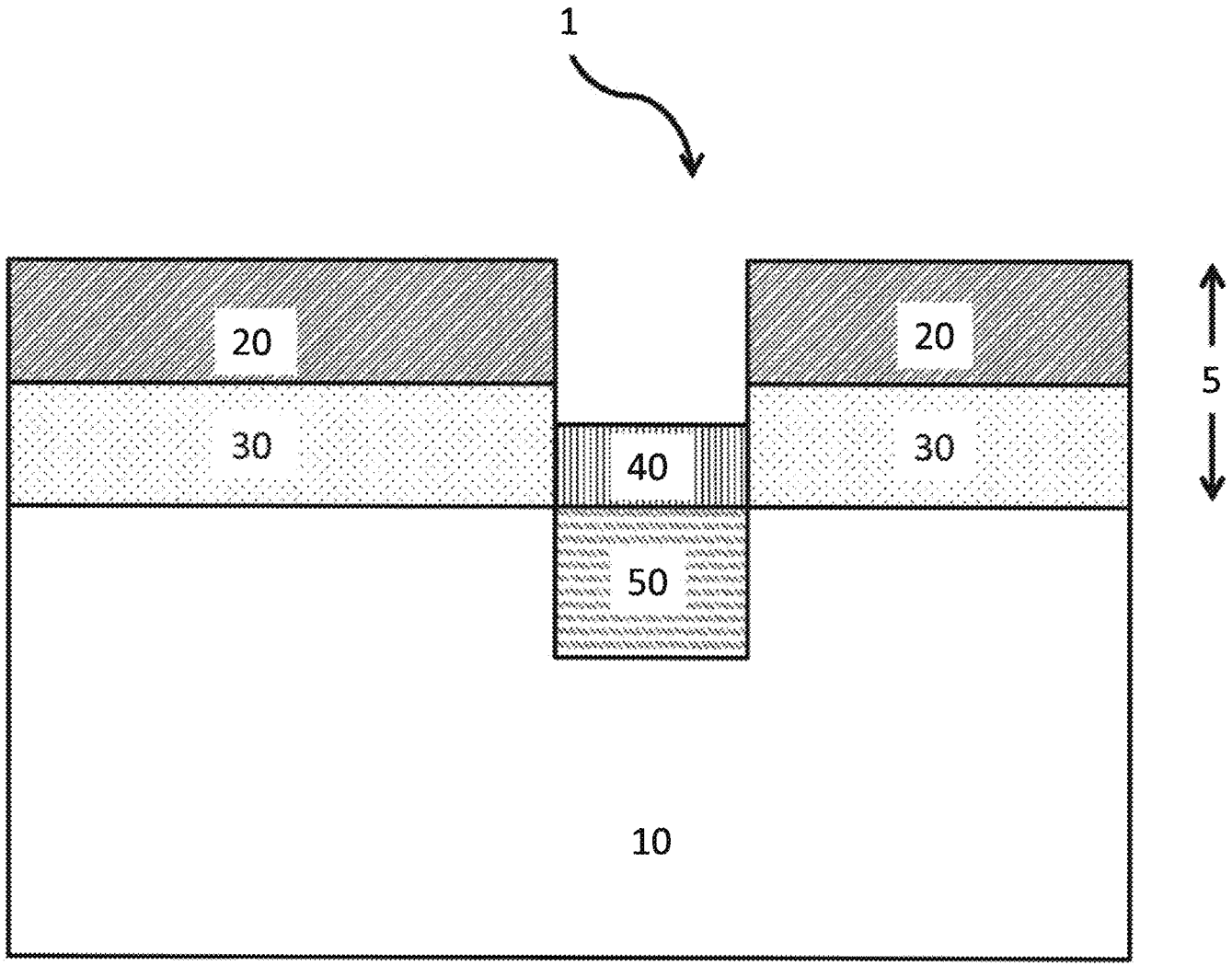
FIG. 1 is a cross-sectional schematic view of an as-received 7xxx aluminum alloy product having surface oxides thereon (not to scale; for illustration purposes only).
Figure 2:
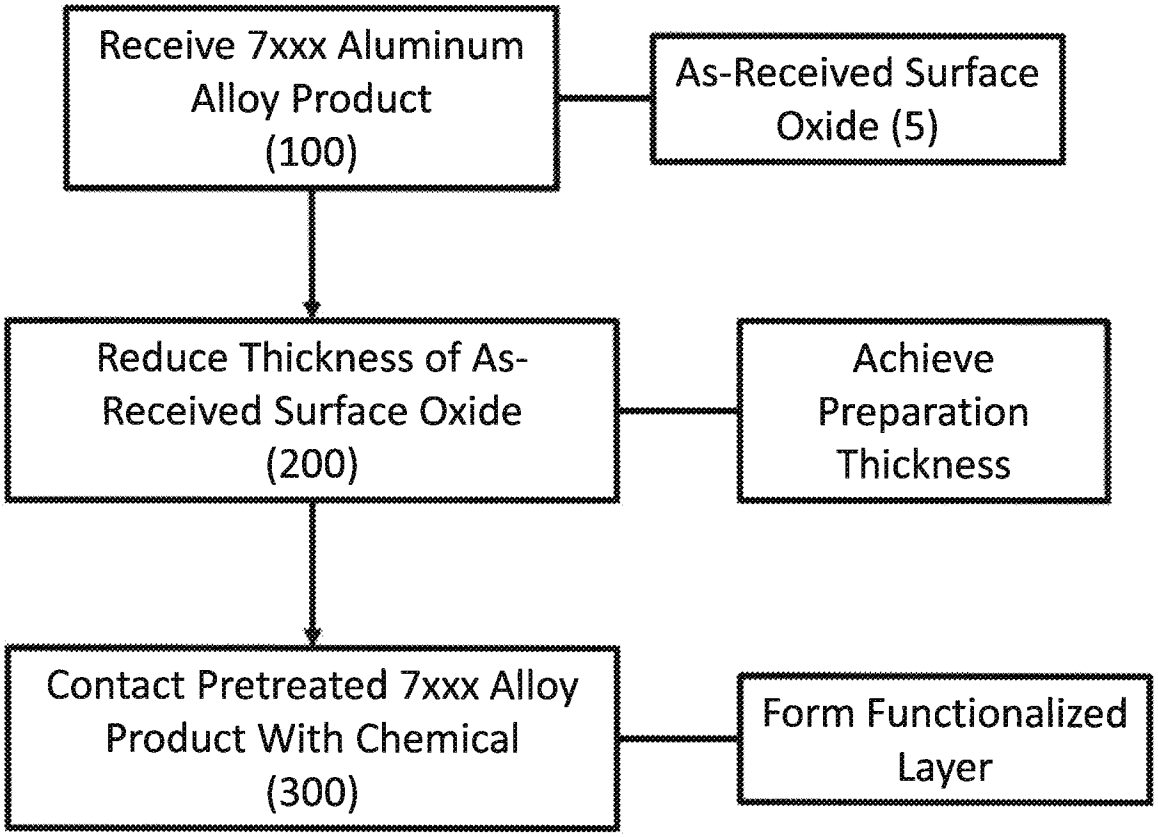
FIG. 2 is a flow chart illustrating one embodiment of a method for producing 7xxx aluminum alloy products in accordance with the present disclosure.
Figure 3:
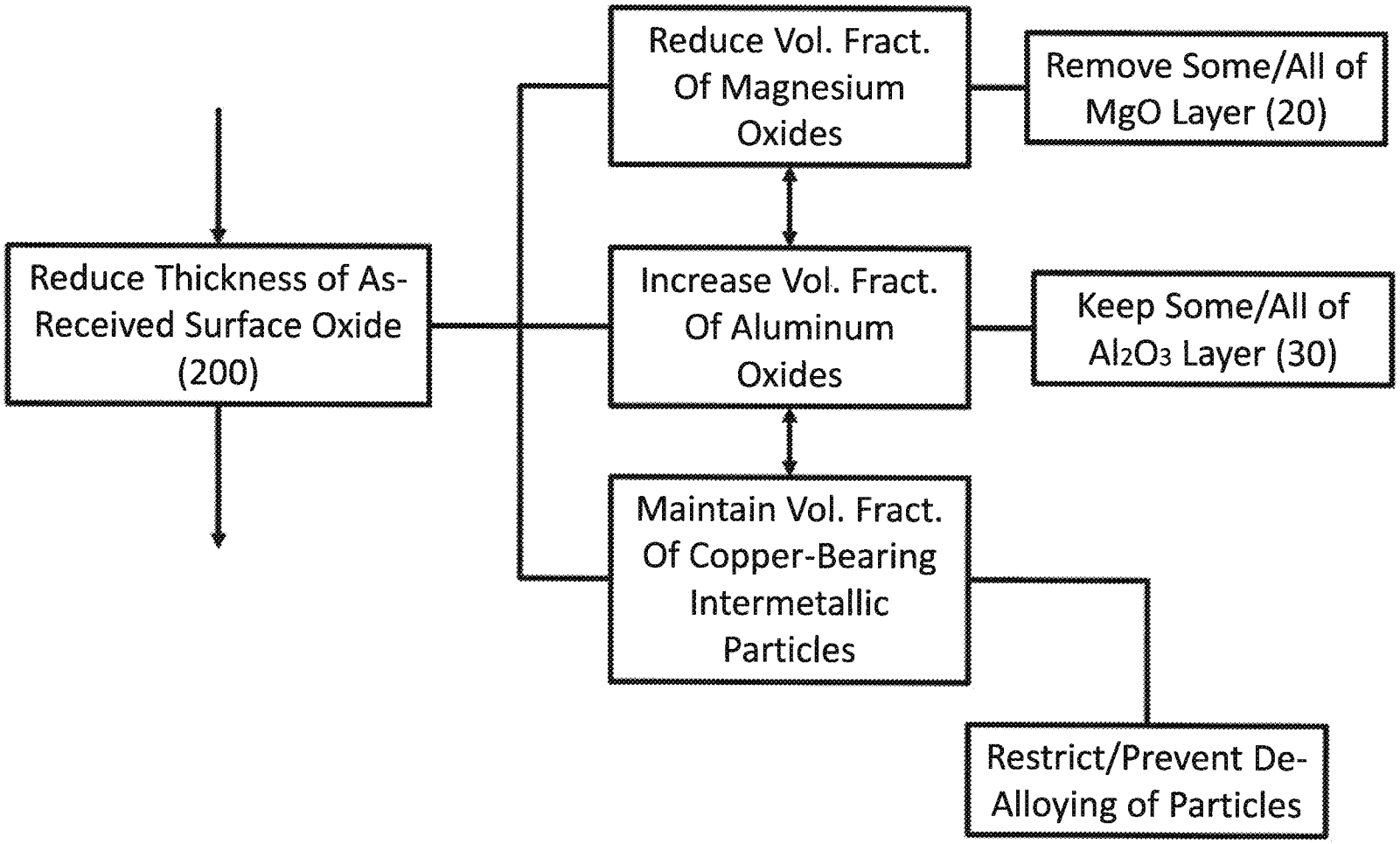
FIG. 3 illustrates various aspects of the reducing step (200) of the FIG. 2.
Figure 4A:
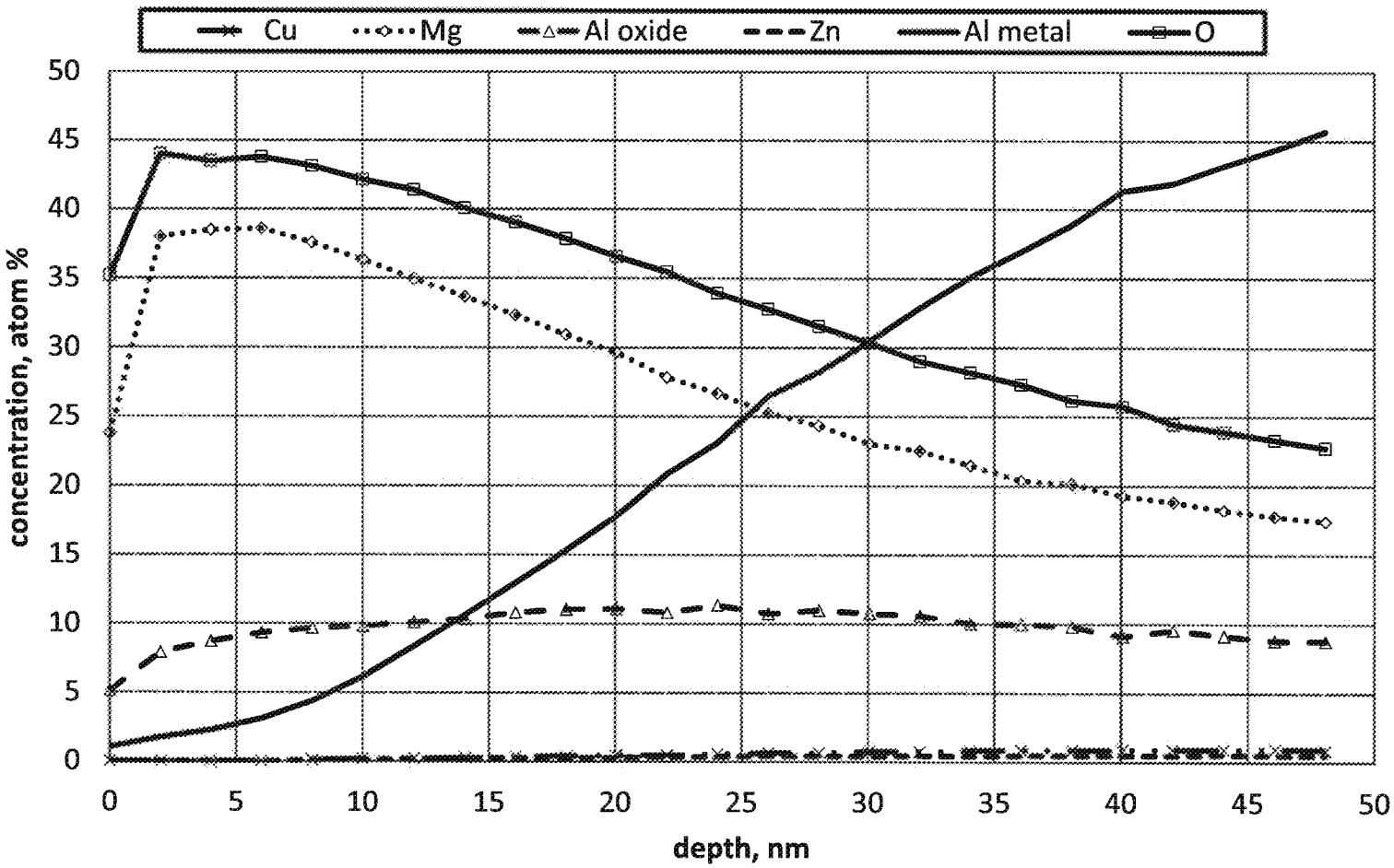
FIGS. 4*a*-4*b*, 5*a*-5*b*, and 6*a*-6*b* are XPS graphs from Example 1 illustrating various concentrations and thicknesses of various 7xxx aluminum alloy products, the figures being as-received (FIG. 4*a*-4*b*), prepared (FIG. 5*a*-5*b*), and functionalized (FIG. 6*a*-6*b*).
Figure 4B:
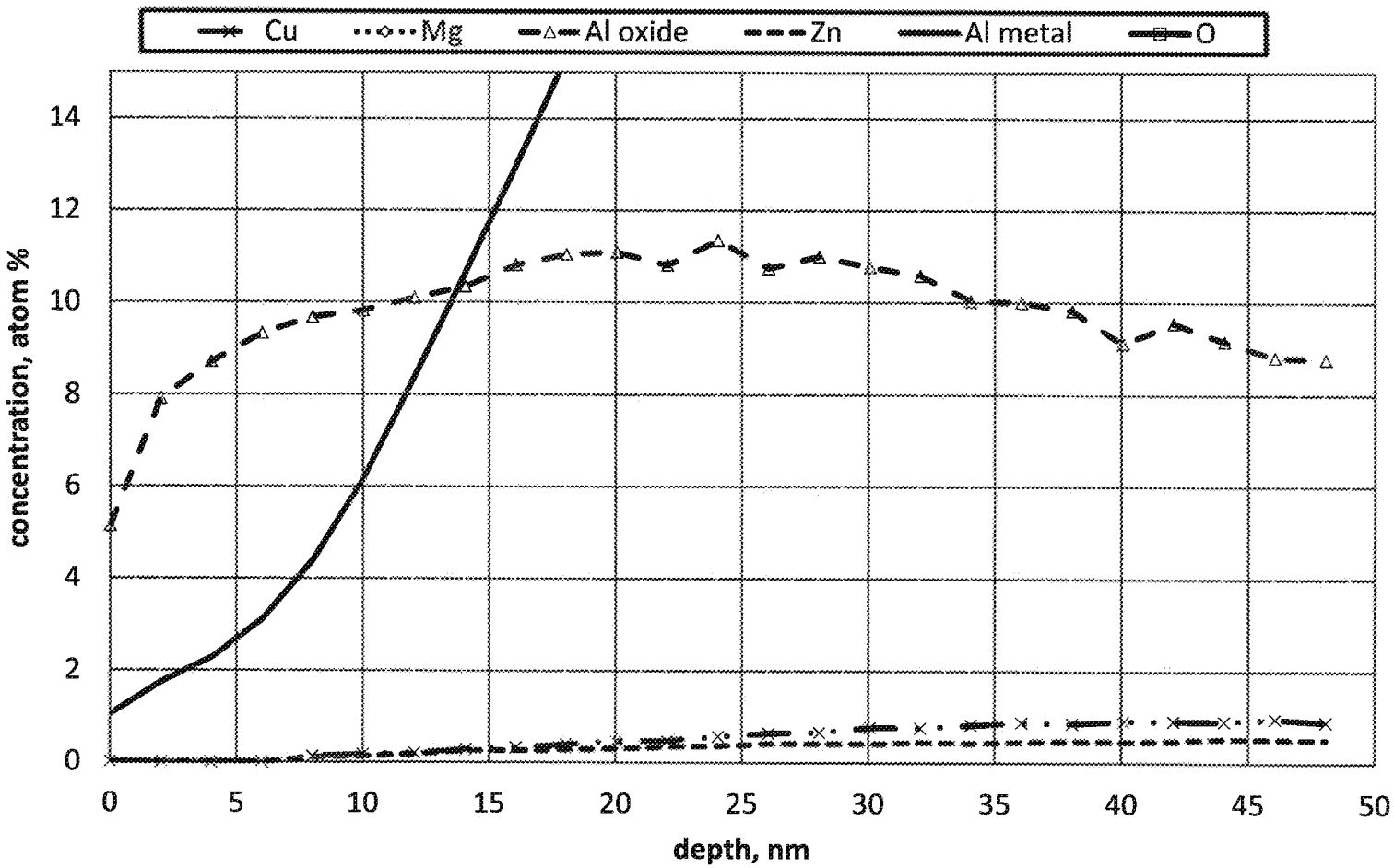
Figure 5A:
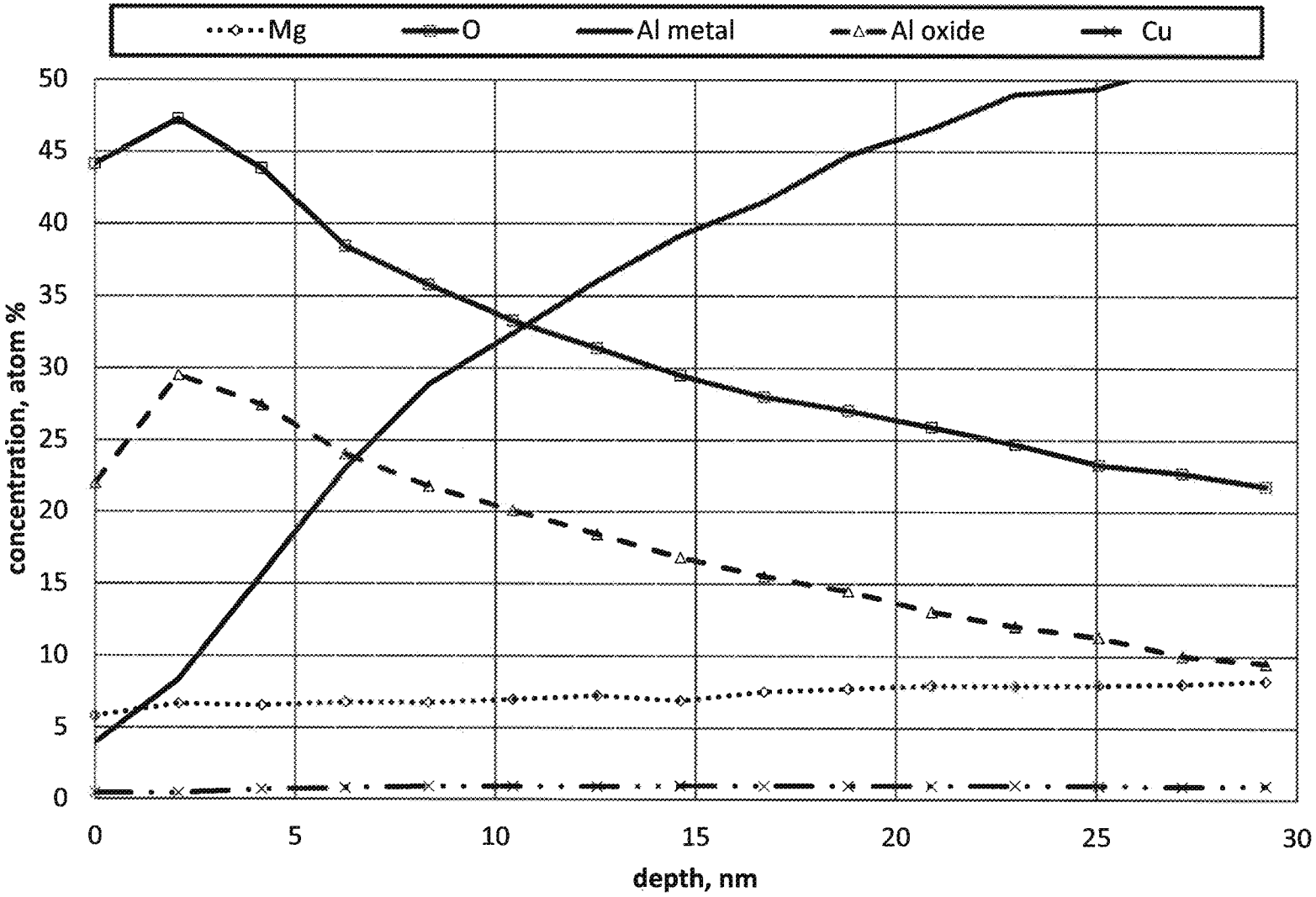
Figure 5B:
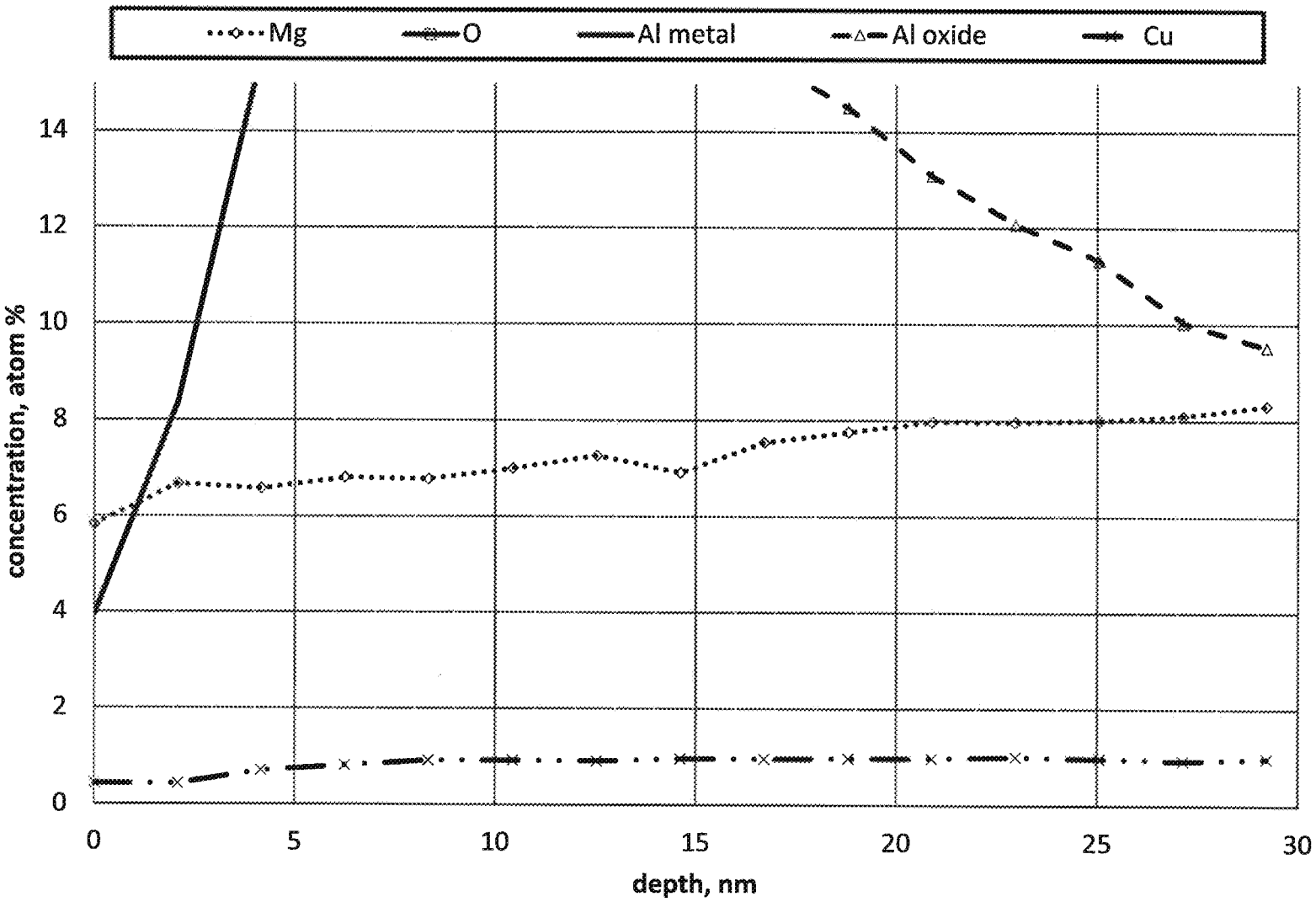
Figure 6A:
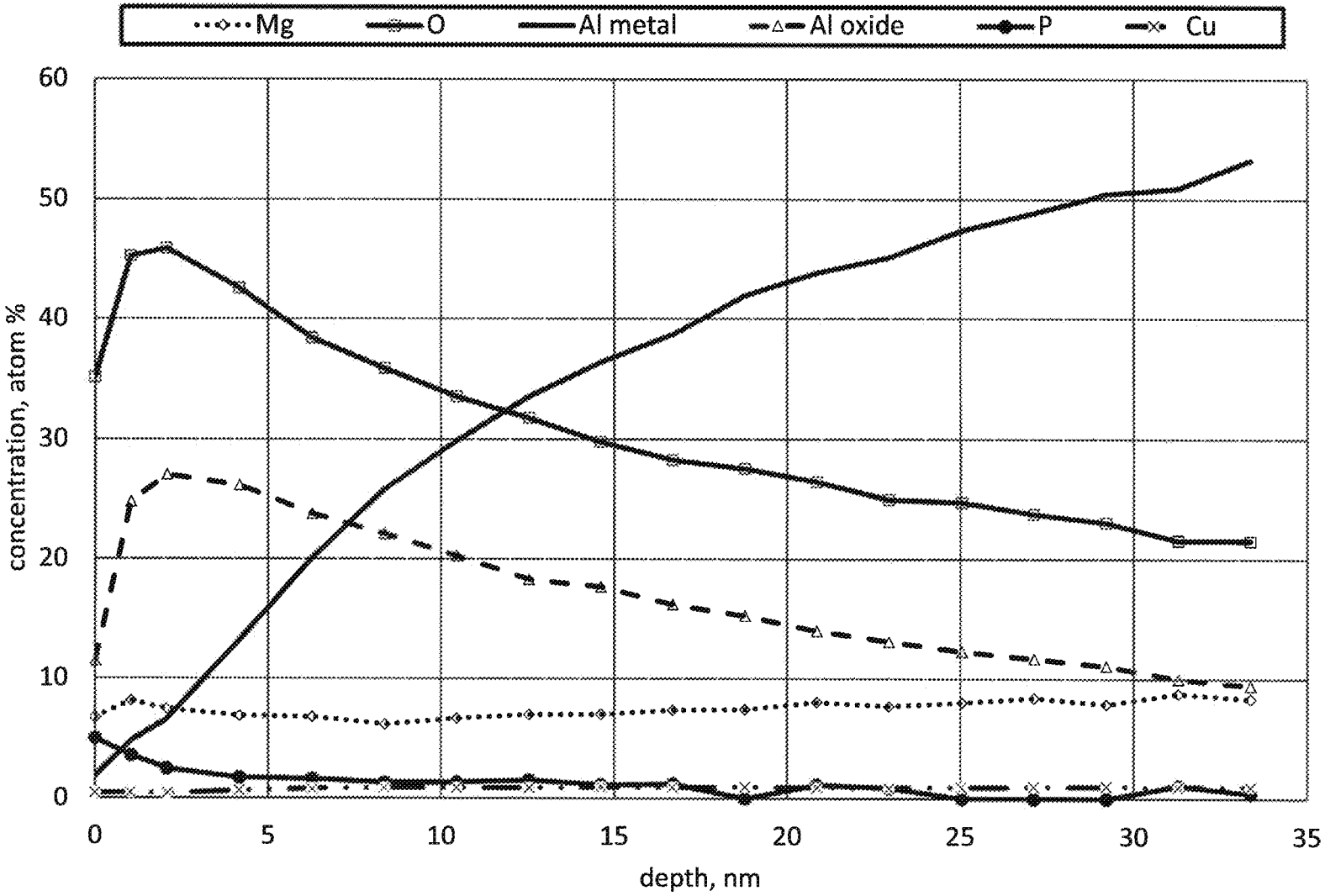
Figure 6B:
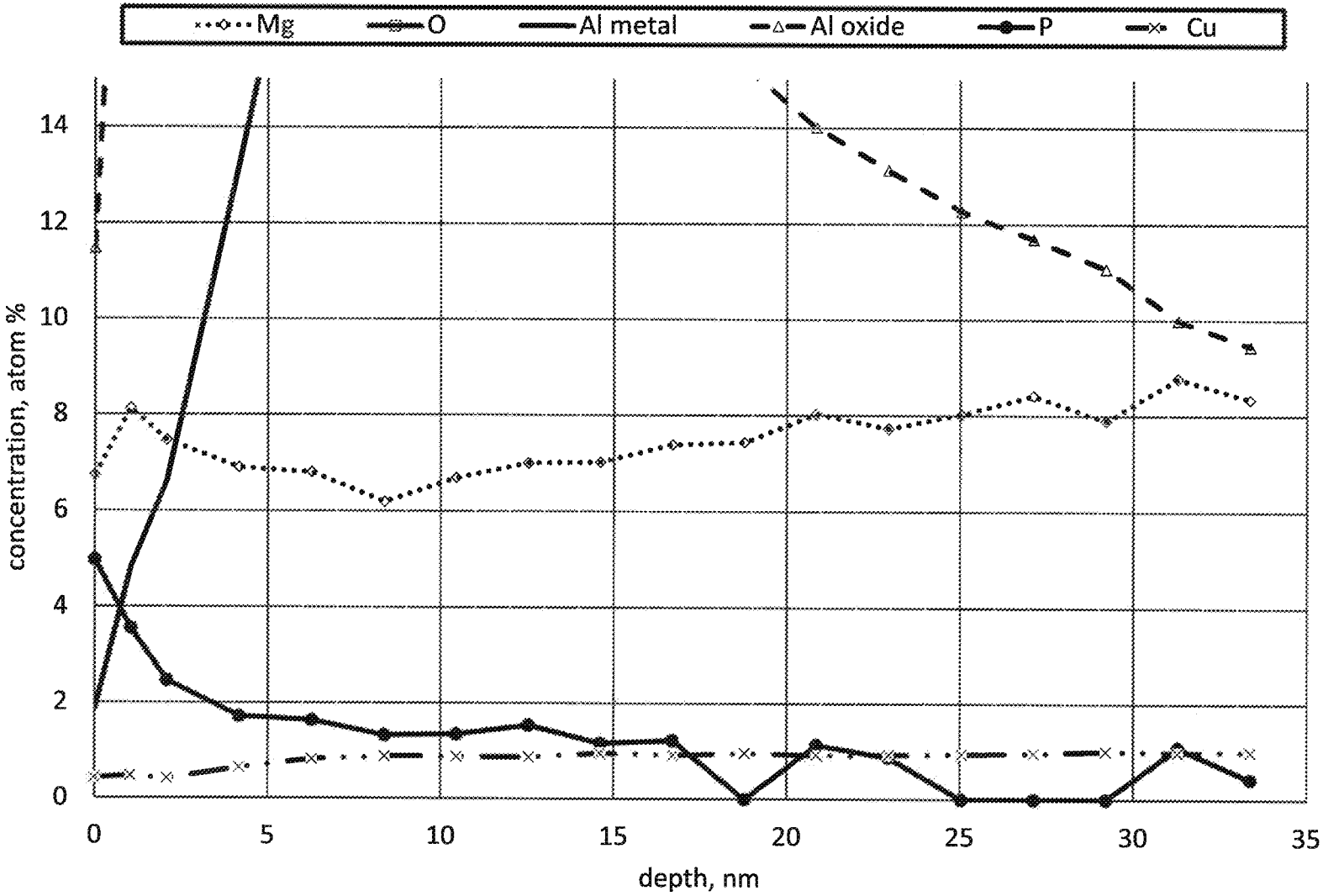
Figure 8:
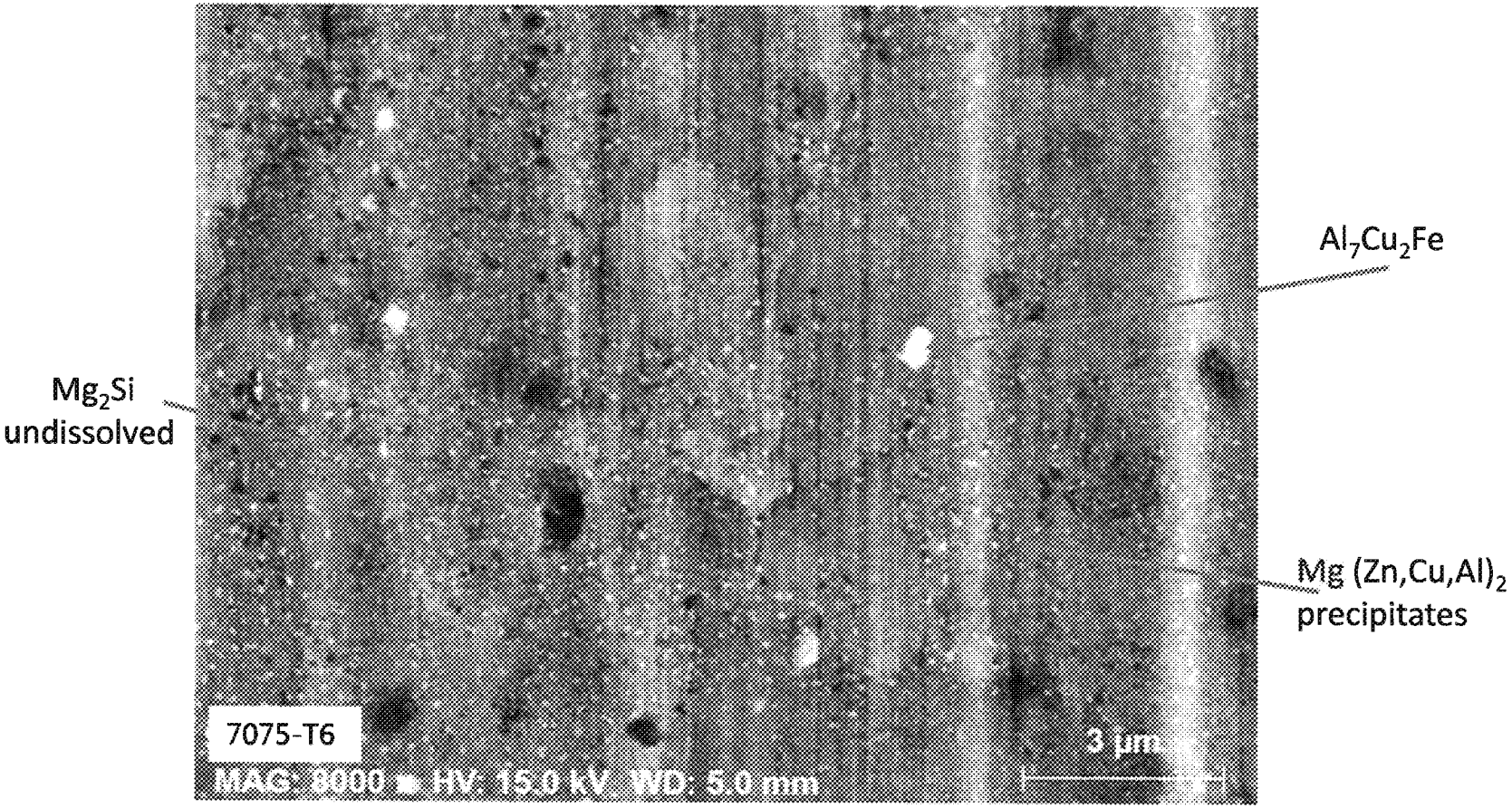
FIG. 8 is an SEM micrograph showing typical microstructural features of an as-received oxide of 7075-T6.

A 7xxx aluminum alloy sheet (7075-T6) was received and cut into various samples. FIG. 8 shows a typical as-received oxide. The as-received oxide thickness and compositions were measured via XPS (X-ray photoelectron spectroscopy), the results of which are show in FIG. 4*a*-4*b*, below. The surfaces of these 7075-T6 samples were then prepared by wiping via a solvent (e.g., hexane or acetone) to remove organic contaminants and dirt, followed by contacting with a dilute BONDERITE 4215 NC solution at 140° F. for 2 minutes. Due to this preparation, the oxide thickness of the samples were reduced. For one sample, the oxide thickness was reduced to less than 11 nm, as shown in FIG. 5*a*-5*b*, with a substantial reduction of the magnesium oxide content (to less than 10 at. % Mg). The samples were then rinsed in city water for 2 minutes and were found to be water-break free, indicating sufficient removal of organic contaminants and dirt. The samples were then treated with an organic phosphoric-containing acid at 150° F. for 8 seconds to produce a functionalized layer thereon. FIG. 6*a*-6*b* illustrates the XPS measurement of one sample with a functionalized layer thereon. As illustrated, the composition and the thickness of oxide remain unchanged, with the net effect being the intended penetration of the acid into the oxide layer, which is indicated by the presence of phosphorus (P) to a depth of 8 nm. The removed magnesium oxides facilitates this penetration.

The samples were then sequentially bonded and then subjected to an industry standard cyclical corrosion exposure test, similar to ASTM D1002, which continuously exposes the samples to 1080 psi lap shear stresses to test bond durability. Surprisingly, all samples (four in this case) completed the required 45 cycles. The samples were found to have 6102, 6274, 6438, and 6101 psi retained shear strength after the testing, well above the nominal value of 5000 psi generally obtained in 5xxx alloys, and comparable to those observed in 6xxx alloys. These results indicate that no substantial de-alloying of the copper-containing intermetallic particles occurred during the BONDERITE preparation, resulting in appropriate production of a functionalized layer thereon.

Example 2—Preparation with Alkaline Solution Followed by Acidic Solution

Figure 9:
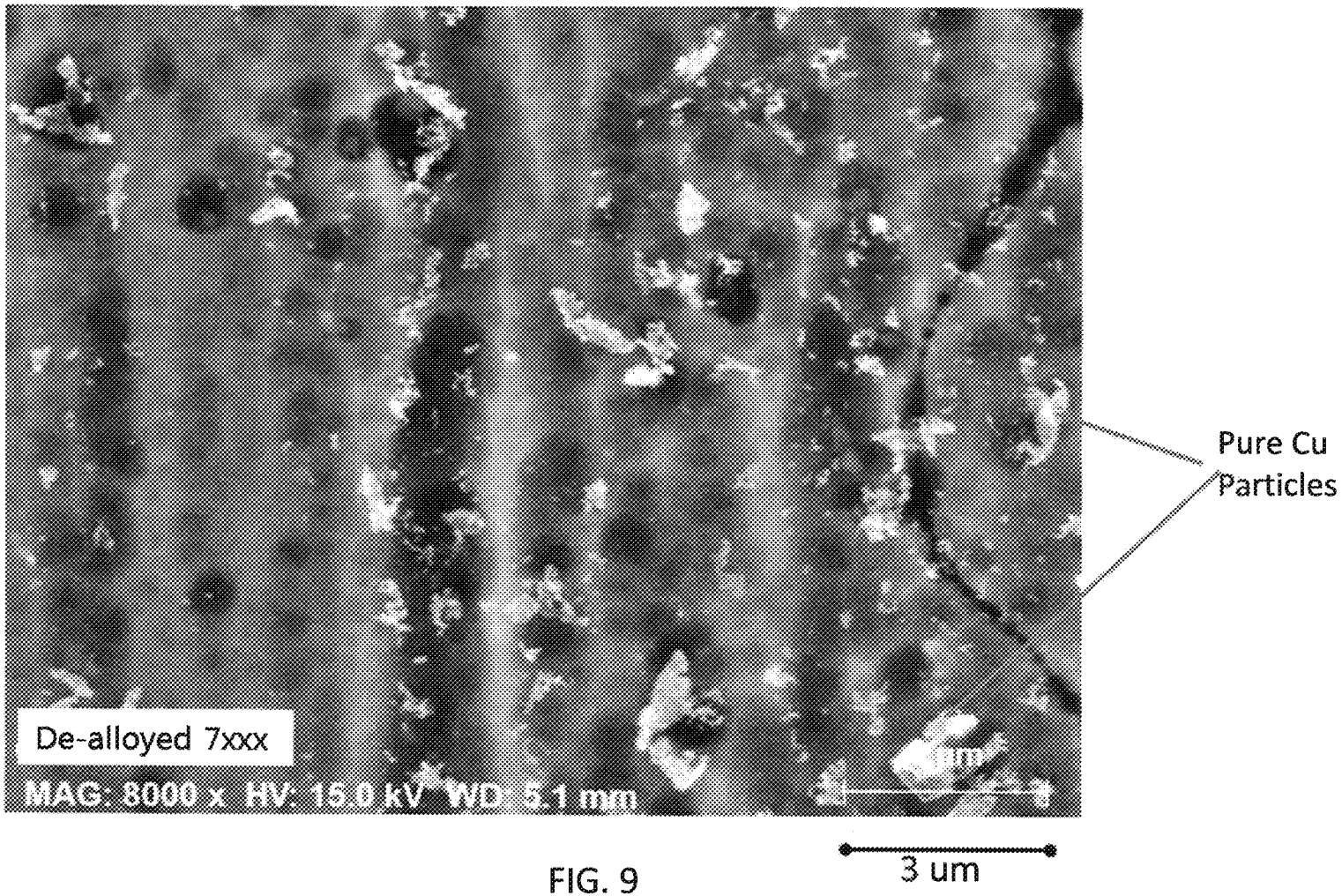
FIG. 9 is an SEM micrograph showing pure elemental copper particles in the 7075-T6 product due to de-alloying of copper-bearing intermetallic particles.

For example 2, the same 7075-T6 sheet and procedure was used as per example 1, except after the BONDERITE preparation and rinse, a conventional acid preparation was used (6.5 vol. % Deoxidizer LFN by CLARIANT, BU Masterbatches, Rothausstrasse 61, CH-4132 Muttenz, Switzerland), followed by another rinse, and then application of the organic phosphoric-containing acid. The samples from this example 2 were then subjected to the same lap shear stress testing as per example 1. All samples failed after no more than 7 cycles, indicating substantial de-alloying of the copper-bearing intermetallic particles occurred during the preparation, resulting in elemental copper being present and interfering with production of the functional layer. FIG. 9 shows such elemental copper particles.

Example 3—Preparation with Acidic Solution

For example 3, the same 7075-T6 sheet and procedure was used as per example 1, except an 8 wt. % nitric acid solution was used in lieu of the BONDERITE preparation. The nitric acid temperature was 80° F. and the treatment time was 60 seconds. The samples from this example 3 were then subjected to the same lap shear stress testing as per example 1. Surprisingly, all samples completed the required 45 cycles. The samples were found to have an average retained shear strength of 5600 psi after testing, indicating sufficient bonding occurred.

Example 4—Media Blasting

Figure 7A:
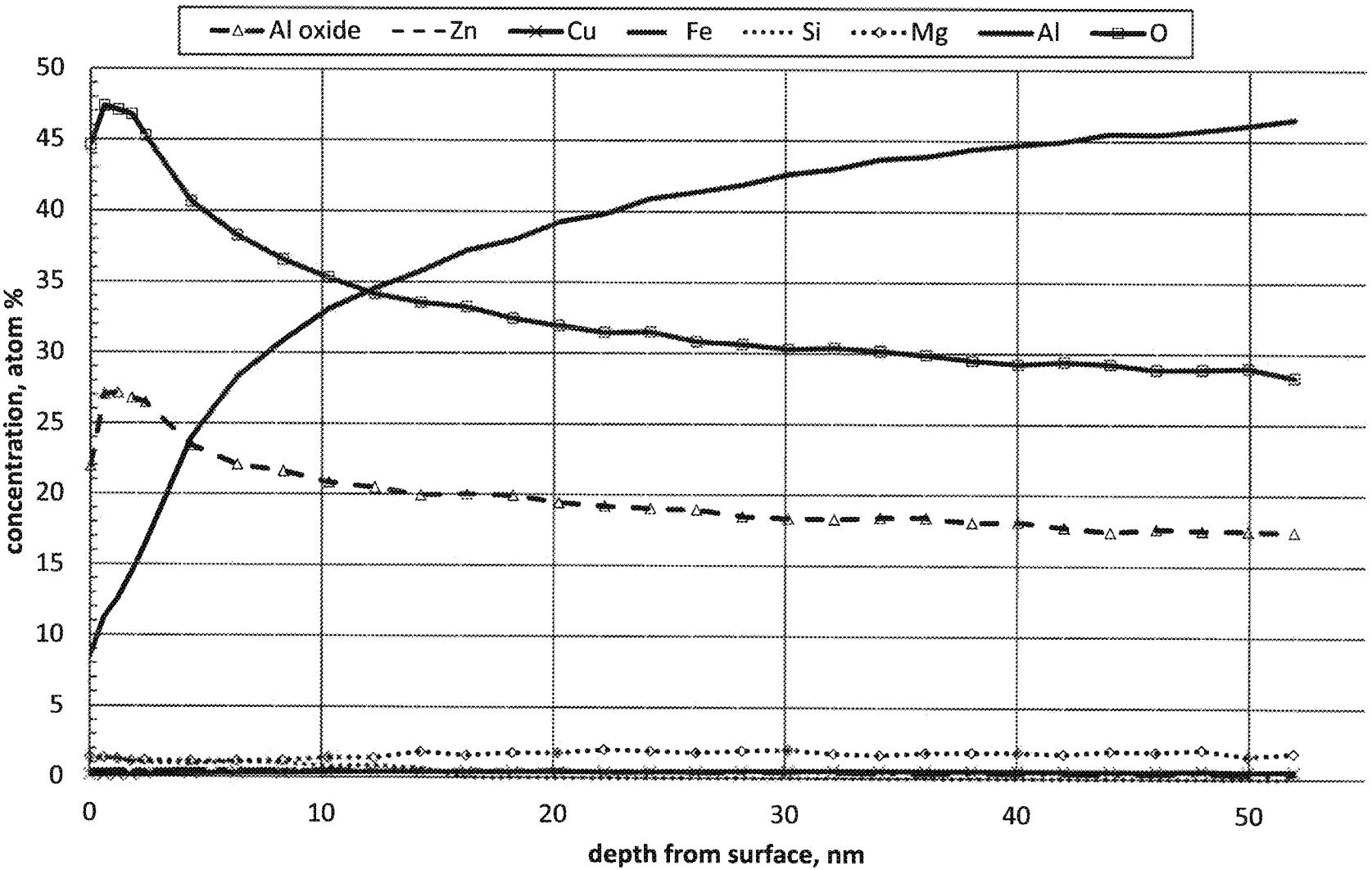
FIGS. 7*a*-7*b* are XPS graphs from Example 4 illustrating various concentrations and thicknesses of various 7xxx aluminum alloy products after mechanical abrasion.
Figure 7B:
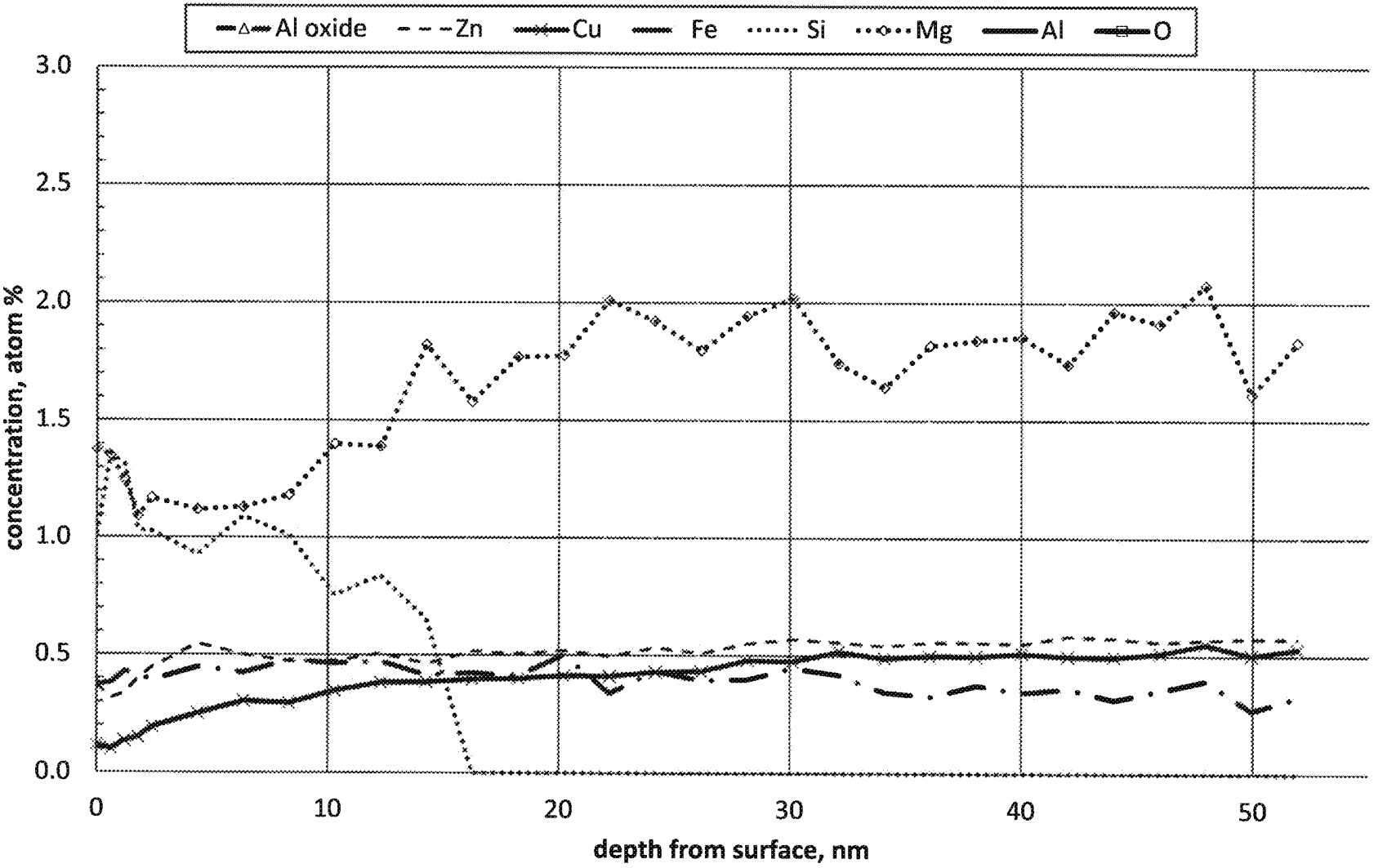

For example 4, the same 7075-T6 sheet was used, but, instead of a chemical preparation, media blasting was used to reduce the as-received oxide thickness. As shown in FIGS. 7*a*-7*b*, the blasting removed the magnesium oxide layer (within the accuracy of the XPS) and without any chemical attack. The blasting also beneficially created a roughened surface for the subsequent functionalization layer creation.

Whereas particular embodiments of this invention have been described above for purposes of illustration, it will be evident to those skilled in the art that numerous variations of the details of the present invention may be madepc without departing from the invention as defined in the appending claims.

What is claimed is:

1. A method comprising:

(a) receiving a 7xxx aluminum alloy sheet, wherein the 7xxx aluminum alloy sheet comprises a surface oxide layer;

(i) wherein the surface oxide layer comprises an as-received thickness;

(ii) wherein the surface oxide layer comprises magnesium oxides and aluminum oxides;

(iii) wherein the 7xxx aluminum alloy sheet comprises copper-bearing intermetallic particles at least proximal the surface oxide layer;

(b) reducing the as-received thickness of the surface oxide layer to a preparation thickness, wherein the reducing comprises maintaining a volume fraction of the copper-bearing intermetallic particles proximal the surface oxide layer;

(c) after the reducing step (b), creating a functional layer bonded to the 7xxx aluminum alloy sheet.

2. The method of claim 1, wherein the copper-bearing intermetallic particles comprise $Al_7Cu_2Fe$ particles.

3. The method of claim 1, wherein the reducing step (b) comprises:

contacting the surface oxide layer with a preparation solution for a time sufficient to reduce the as-received thickness to the preparation thickness while maintaining the volume fraction of the copper-bearing intermetallic particles proximal the surface oxide layer.

4. The method of claim 3, wherein the preparation solution is alkaline.

5. The method of claim 4, wherein the preparation solution comprises a pH of not greater than 10.

6. The method of claim 4, wherein the contacting step occurs for at least 20 seconds.

7. The method of claim 4, wherein the contacting step occurs for at least 60 seconds.

8. The method of claim 4, wherein the contacting step occurs for at least 90 seconds.

9. The method of claim 4, wherein the preparation solution comprises a preparation temperature during the contacting step, wherein the preparation temperature is from 100-150° F.

10. The method of claim 3, wherein the preparation solution is acidic.

11. The method of claim 10, wherein the preparation solution comprises a pH of not greater than 3.

12. The method of claim 10, wherein the preparation solution is nitric acid.

13. The method of claim 10, wherein the preparation solution comprises a preparation temperature during the contacting step, wherein the preparation temperature is from 70-90° F.

14. The method of claim 3, wherein the reducing step (b comprises contacting the surface oxide layer with a preparation solution for a time sufficient to reduce the as-received thickness to the preparation thickness and in the absence of substantial de-alloying of the copper-bearing intermetallic particles proximal the surface oxide layer.

15. The method of claim 1, wherein the reducing step comprises mechanical preparation.

16. The method of claim 15, wherein the mechanical preparation comprises media blasting.

17. The method of claim 15, wherein the mechanical preparation comprises at least one of grit blasting, machining and sanding.

18. The method of claim 1, wherein, after the reducing step, the preparation thickness of the surface oxide layer is not greater than 20 nm.

19. The method of claim 1, wherein, due to the reducing step (b), the surface oxide layer comprises not greater than 10 at. % magnesium oxides.

20. The method of claim 1, wherein the 7xxx aluminum alloy product comprises 2-12 wt. % Zn, 1-3 wt. % Mg, and 1-3 wt. % Cu.

* * * * *